US009103128B2

(12) United States Patent
Pomberger

(10) Patent No.: US 9,103,128 B2
(45) Date of Patent: Aug. 11, 2015

(54) COVERING PANEL

(75) Inventor: Peter Pomberger, Wals (AT)

(73) Assignee: M. Kaindl, Wals (AT)

( * ) Notice: Subject to any disclaimer, the term of this patent is extended or adjusted under 35 U.S.C. 154(b) by 2261 days.

(21) Appl. No.: 10/548,105

(22) PCT Filed: Feb. 18, 2004

(86) PCT No.: PCT/AT2004/000049

§ 371 (c)(1),
(2), (4) Date: Jun. 23, 2006

(87) PCT Pub. No.: WO2004/079128

PCT Pub. Date: Sep. 16, 2004

(65) Prior Publication Data

US 2006/0272262 A1 Dec. 7, 2006

(30) Foreign Application Priority Data

Mar. 7, 2003 (AT) ..... A 358/2003

(51) Int. Cl.
*E04F 13/08* (2006.01)
*E04F 15/02* (2006.01)
*E04F 15/04* (2006.01)

(52) U.S. Cl.
CPC ..... *E04F 13/08* (2013.01); *E04F 15/02* (2013.01); *E04F 15/04* (2013.01); *E04F 2201/049* (2013.01); *E04F 2201/07* (2013.01)

(58) Field of Classification Search
CPC ..... E04F 13/08; E04F 15/02; E04F 15/04; E04F 2201/049; E04F 2201/07
USPC ..... 52/578, 589.1, 582.1, 419
See application file for complete search history.

(56) References Cited

U.S. PATENT DOCUMENTS 1,540,128 A * 6/1925 Houston ..... 52/578
1,575,821 A * 3/1926 Daniels ..... 52/391
1,602,256 A * 10/1926 Sellin ..... 52/591.1

(Continued)

FOREIGN PATENT DOCUMENTS

CA 2 434 168 7/2002
DE 202 16 584 1/2003

(Continued)

OTHER PUBLICATIONS

Abstract of DE 202 16 584—Published Jan. 16, 2003—Kaindl Wals.

(Continued)

*Primary Examiner* — James Ference
(74) *Attorney, Agent, or Firm* — Millen, White, Zelano & Branigan, P.C.

(57) ABSTRACT

A cladding panel for floors has a groove (12) along at least one edge or end face (17) and a tongue (6) along at least one other edge or end face (17). The cross-sections of the tongue (6) and the groove (12) are matched to one another and the panels (1, 2) being connectable by inserting the tongue (6) into the groove (12). On at least one wall surface (5) of the groove (12) and/or on at least one tongue surface (7), at least one bead (8) of cement is applied. On the tongue surface (7) there is a bead (8) that faces the wall surface (5) of the groove (12), the wall surface is also provided with a bead (9). The two beads (8, 9) are locked to one another after insertion of the tongue (6) into the groove (12). In other embodiments there may be additional beads (8) and (9) on the surfaces of the tongue (6) or groove (12), or positioned within recesses (10).

55 Claims, 6 Drawing Sheets

(56) References Cited

U.S. PATENT DOCUMENTS

Figure 1:
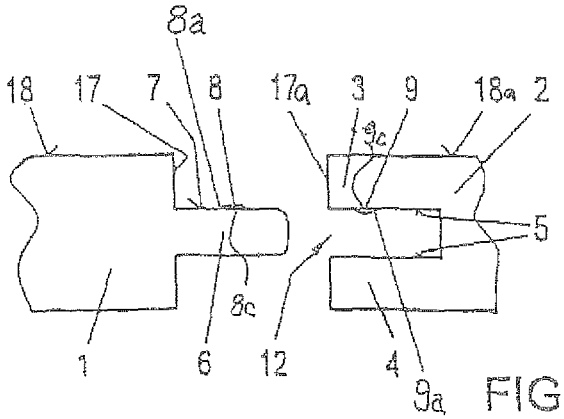

| | | | | | |
|---|---|---|---|---|---|
| 1,602,267 | A * | 10/1926 | Karwisch | 52/591.1 |
| 1,660,480 | A * | 2/1928 | Daniels | 52/390 |
| 1,718,702 | A * | 6/1929 | Pfiester | 52/391 |
| 1,778,069 | A * | 10/1930 | Fetz | 52/391 |
| 1,846,658 | A * | 2/1932 | Rockwell | 403/265 |
| 2,736,930 | A * | 3/1956 | Longley | 52/211 |
| 2,839,790 | A * | 6/1958 | Collings | 52/591.2 |
| 2,894,292 | A * | 7/1959 | Gramelspacher | 52/474 |
| 3,719,015 | A * | 3/1973 | Misawa | 52/236.9 |
| 3,943,022 | A * | 3/1976 | Susnjara | 156/211 |
| 3,998,024 | A * | 12/1976 | Frandsen | 52/592.1 |
| 4,037,377 | A * | 7/1977 | Howell et al. | 52/309.9 |
| 4,095,388 | A * | 6/1978 | Breault | 52/747.11 |
| 4,769,963 | A * | 9/1988 | Meyerson | 52/309.9 |
| 4,944,416 | A * | 7/1990 | Petersen et al. | 52/36.5 |
| 5,165,816 | A * | 11/1992 | Parasin | 403/334 |
| 5,216,861 | A * | 6/1993 | Meyerson | 52/586.2 |
| 5,362,560 | A * | 11/1994 | Ehrhart et al. | 428/343 |
| 5,381,638 | A * | 1/1995 | Andersson | 52/592.1 |
| 5,497,589 | A * | 3/1996 | Porter | 52/309.7 |
| 5,502,939 | A * | 4/1996 | Zadok et al. | 52/309.9 |
| 5,618,602 | A * | 4/1997 | Nelson | 428/60 |
| 5,755,068 | A * | 5/1998 | Ormiston | 52/314 |
| 5,827,592 | A * | 10/1998 | Van Gulik et al. | 428/44 |
| 5,830,549 | A * | 11/1998 | Sweet et al. | 428/40.1 |
| 5,899,038 | A * | 5/1999 | Stroppiana | 52/403.1 |
| 6,006,486 | A * | 12/1999 | Moriau et al. | 52/589.1 |
| 6,021,615 | A * | 2/2000 | Brown | 52/392 |
| 6,029,416 | A * | 2/2000 | Andersson | 52/592.1 |
| 6,101,778 | A * | 8/2000 | Mårtensson | 52/582.1 |
| 6,131,355 | A * | 10/2000 | Groh et al. | 52/592.1 |
| 6,209,278 | B1 * | 4/2001 | Tychsen | 52/592.4 |
| 6,216,409 | B1 * | 4/2001 | Roy et al. | 52/589.1 |
| 6,314,701 | B1 * | 11/2001 | Meyerson | 52/588.1 |
| 6,324,809 | B1 * | 12/2001 | Nelson | 52/592.2 |
| 6,345,481 | B1 * | 2/2002 | Nelson | 52/592.2 |
| 6,397,547 | B1 * | 6/2002 | Mårtensson | 52/582.1 |
| 6,418,683 | B1 * | 7/2002 | Martensson et al. | 52/282.1 |
| 6,421,970 | B1 * | 7/2002 | Martensson et al. | 52/282.1 |
| 6,438,919 | B1 * | 8/2002 | Knauseder | 52/586.2 |
| 6,505,452 | B1 * | 1/2003 | Hannig et al. | 52/582.1 |
| 6,536,178 | B1 * | 3/2003 | Pålsson et al. | 52/589.1 |
| 6,581,351 | B2 * | 6/2003 | DeVivi | 52/592.1 |
| 6,588,166 | B2 * | 7/2003 | Martensson et al. | 52/578 |
| 6,601,359 | B2 * | 8/2003 | Olofsson | 52/588.1 |
| 6,606,834 | B2 * | 8/2003 | Martensson et al. | 52/578 |
| 6,675,544 | B1 * | 1/2004 | Ou et al. | 52/539 |
| 6,682,254 | B1 * | 1/2004 | Olofsson et al. | 403/375 |
| 6,808,777 | B2 * | 10/2004 | Andersson et al. | 428/47 |
| 6,823,638 | B2 * | 11/2004 | Stanchfield | 52/588.1 |
| 6,880,307 | B2 * | 4/2005 | Schwitte et al. | 52/592.1 |
| 7,037,024 | B2 * | 5/2006 | Steinwender | 403/267 |
| 7,093,399 | B2 * | 8/2006 | Thiers et al. | 52/592.1 |
| 7,121,058 | B2 * | 10/2006 | Palsson et al. | 52/592.2 |
| 7,188,456 | B2 * | 3/2007 | Knauseder | 52/592.1 |
| 7,441,384 | B2 * | 10/2008 | Miller et al. | 52/589.1 |
| 2001/0034991 | A1 * | 11/2001 | Martensson et al. | 52/578 |
| 2002/0020127 | A1 * | 2/2002 | Thiers et al. | 52/403.1 |
| 2002/0046526 | A1 * | 4/2002 | Knauseder | 52/581 |
| 2002/0100242 | A1 * | 8/2002 | Olofsson | 52/588.1 |
| 2002/0108343 | A1 * | 8/2002 | Knauseder | 52/592.1 |
| 2002/0112429 | A1 * | 8/2002 | Niese et al. | 52/392 |
| 2002/0148551 | A1 * | 10/2002 | Knauseder | 156/182 |
| 2002/0152707 | A1 * | 10/2002 | Martensson | 52/592.2 |
| 2002/0189747 | A1 * | 12/2002 | Steinwender | 156/157 |
| 2003/0003258 | A1 * | 1/2003 | Durso et al. | 428/53 |
| 2003/0033777 | A1 * | 2/2003 | Thiers et al. | 52/390 |
| 2003/0041545 | A1 * | 3/2003 | Stanchfield | 52/592.1 |
| 2003/0079425 | A1 * | 5/2003 | Morgan et al. | 52/232 |
| 2003/0101681 | A1 * | 6/2003 | Tychsen | 52/783.1 |
| 2003/0141004 | A1 * | 7/2003 | Palmblad et al. | 156/64 |
| 2003/0208980 | A1 * | 11/2003 | Miller et al. | 52/592.1 |
| 2003/0213211 | A1 * | 11/2003 | Morgan et al. | 52/745.05 |
| 2004/0031227 | A1 * | 2/2004 | Knauseder | 52/592.1 |
| 2004/0107665 | A1 * | 6/2004 | Faxe et al. | 52/578 |
| 2004/0211143 | A1 * | 10/2004 | Hanning | 52/578 |
| 2004/0250492 | A1 * | 12/2004 | Becker | 52/578 |
| 2006/0236643 | A1 | 10/2006 | Moriau et al. | |

FOREIGN PATENT DOCUMENTS

| | | | | |
|---|---|---|---|---|
| EP | 1229181 | A1 * | 8/2002 | E04F 15/04 |
| FR | 2205079 | A | 5/1974 | |
| FR | 2647837 | A1 | 12/1990 | |
| GB | 2256023 | A | 11/1992 | |
| GB | 2 377 457 | | 1/2003 | |
| JP | 58 14185 | | 3/1983 | |
| JP | 59 005744 | | 1/1984 | |
| JP | 6 8587 | | 1/1994 | |
| JP | 7 44657 | | 2/1995 | |
| JP | 8 261640 | | 10/1996 | |
| JP | 2001 73535 | | 3/2001 | |
| JP | 2001 193175 | | 7/2001 | |
| JP | 2001 234016 | | 8/2001 | |
| SE | WO9821428 | A1 * | 5/1998 | E04F 15/02 |
| WO | WO-97 47834 | | 12/1997 | |

OTHER PUBLICATIONS

Sekisui Chemical Co. Ltd., "Floor Finishing Structure," Data Supplied from the espacenet worldwide database, Publication Date: Mar. 21, 2001; English Abstract of JP 2001-073535.

Unilin Beheer BV, "Floor Covering, Consisting of Hard Floor Panels and Method for Manufacturing such Floor Panels," Data Supplied from the espacenet worldwide database, Publication Date: Dec. 18, 1997; English Abstract of WO97 47834.

Mannington Mills, "Thermoplastic Plank and Method for Producing the Same," Data Supplied from espacenet worldwide database, Publication Date: Aug. 28, 2001; English Abstract of JP 2001 234016.

Showa Aluminum Corp., "Joining Device for Panels," Data Supplied from the espacenet worldwide database, Publication Date: Oct. 11, 1996; English Abstract of JP 8 261640.

Daiken Trade & Industry, "Connecting Structure of Wooden Building Plate," Data Supplied from the espacenet worldwide database, Publication Date: Jul. 17, 2001; English Abstract of JP 2001 193175.

English Translation of the Reason for Rejection for Japanese Patent Application No. 2004 528159 dispatched on Feb. 26, 2010.

Office Action for Related Canadian Application No. 2 517 907 dated Mar. 22, 2011.

* cited by examiner

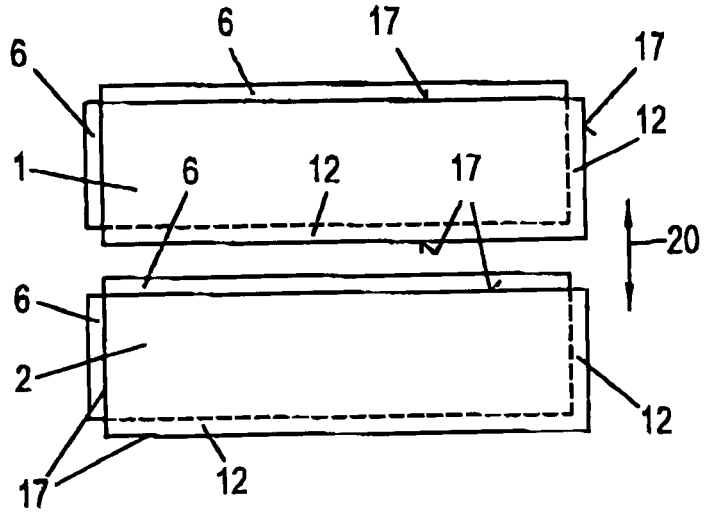
FIG. 9
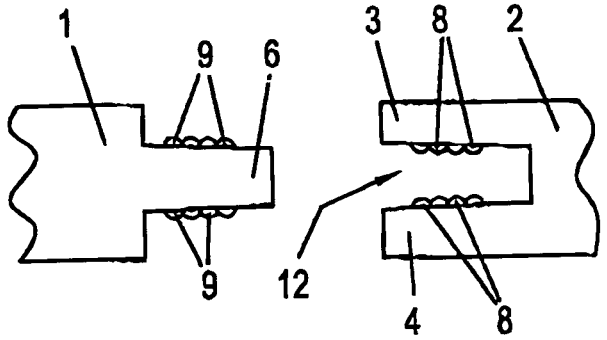
FIG. 8a
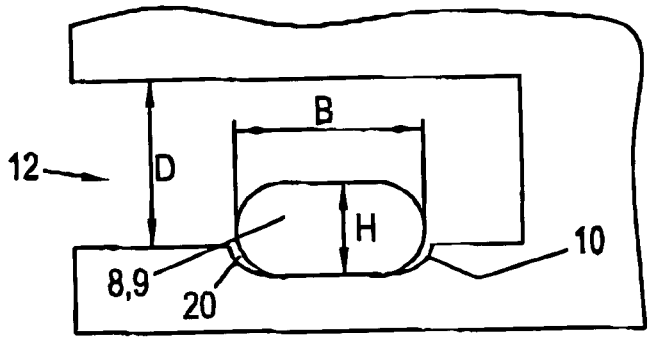
FIG. 13
FIG. 10a
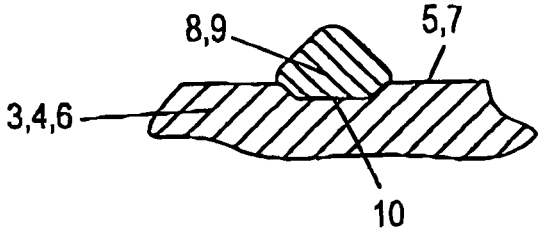
FIG. 10
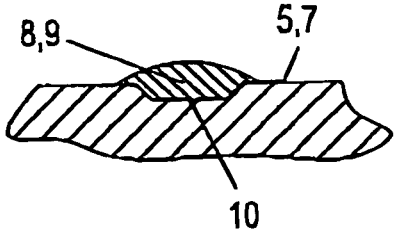

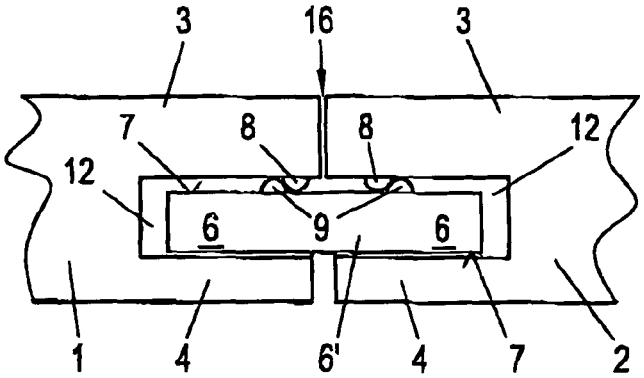
FIG. 11
FIG. 12
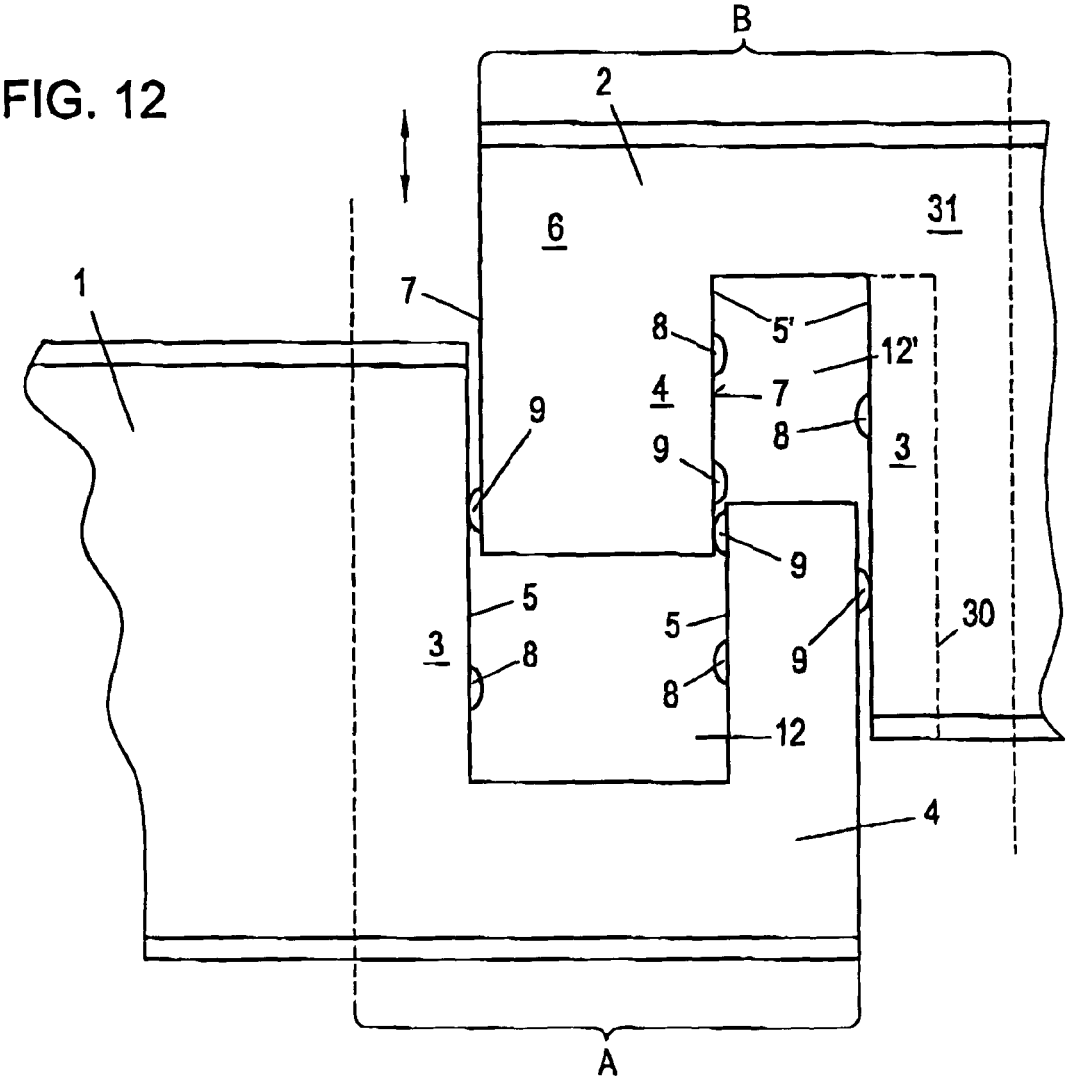

COVERING PANEL

The invention relates to a cladding panel for floors, walls or ceilings or similar applications according to the preamble of claim 1.

These panels on their side surfaces have grooves and tongues in order to lay these panels in a structure. In order to achieve as stable a structure as possible, it can also be provided that the panels be cemented to one another.

The priority objective of the invention is to be able to produce panels of the initially mentioned type as easily and economically as possible, furthermore to enable their storage over longer time intervals without adverse effects and in a space-saving manner, and finally to make the installation and in any case disassembly as quick and simple as possible, in a manner that preserves the panels as much as possible. Another objective is to prepare a stable, durable and solid surface from panels that have been joined to one another; alignment of the panels over a certain time interval will also be possible during installation.

These objectives are achieved in a cladding panel of the initially mentioned type with the features cited in the characterizing part of claim 1.

According to the invention, in the tongue or on at least the inside surface of one of the legs of the groove and/or on at least one surface of the tongue, at least one bead or strip is applied, for the locking of which another bead or strip is applied on the respectively assigned, and especially contacting surface of the tongue and/or groove. In this way, in the course of installing the cladding panels or in the course of joining them together, the beads act as locking means; the bead and the other bead interact as catch and locking elements. In the formation of at least one of the two beads with a cement, an adhesive connection between the groove and the tongue can be achieved. The beads of plastic and/or cement are applied at the factory in a simple and quick procedure, e.g., sprayed on.

A material working process, e.g., milling, to form a locking element is eliminated.

It is simply more necessary to make another bead assigned to one bead in the wall surface of the groove and/or in the tongue surfaces. This type of connecting technology and optionally cementing technology can be used for cladding panels of any materials, wood, wood materials, especially MDF, HDF, chips, etc.

A series of plastics are known that can be applied as the corresponding bead or strip or the other bead or strip to the surfaces of the groove and/or tongue. In particular, silicone plastics, plastics based on polyalkylene, especially PVC, PE, PP and hot-melt cements based on neoprene can be used for this purpose. It should be possible to deform such plastics by heat or for them to seal by heat and to extrude or shape them in bead form and to make them solidify in an adhesive manner on the respective material of the panel. In use, they are to have corresponding elasticity and viscosity in order to be able to act as a catch element.

Especially thermoplastics, elastomers and thermoplastic elastomers are suitable as thermally deformable plastics. As thermoplastics, polyolefins, vinyl polymers, polyamides, polyesters, polyurethane and ionomers can be used. As elastomers, various types of rubber can be used. As thermoplastic elastomers, TPE, TPR, TPO, SPS, TP-Q, and TP-U are suitable. As plastics, hot-melt cements or hot-sealing cements based on ethylene vinyl chloride, PA, PU, and EVA can also be used. Other plastics can also be used.

A series of cements are known that have sufficient strength to not be removed or to be damaged in their surface configuration when the tongue is pushed into the groove, but based on the penetrating atmospheric humidity and/or by application of water in the course of installation or use, they can be sufficiently activated to fully develop their adhesive action. After setting of the cement of the cement bead(s), the latter take action, on the one hand, based on the adhesive action, and, on the other hand, based on the locking action that has developed; the beads either interact with respect to their adhesive action and/or interact with the material of the tongue or the groove. It should be possible to apply the cements and plastics used to the respective material of the panel using a nozzle and for them to adhere well there.

Such cladding panels have the advantage that the handling and manipulation steps are greatly reduced when installing the panels on site; it is simply necessary to introduce water into the groove using a corresponding device and/or apply it to the tongue in order to activate the cement if this is desired at all. If it is a cement that hardens as a result of the existing moisture in the air, this procedure also is not necessary.

One special advantage is that due to the mass of the cement that is provided in the cement bead at the factory, a correctly dimensioned or sufficient amount of cement is present, and handling or removal of cement that has been applied in excess in any case or emergence of the cement from the tongue-in-groove connection is eliminated.

To achieve the catch and/or adhesive connection, relatively small amounts of cement are sufficient. In particular, contact between the groove and the tongues over as large an area as possible is to be achieved.

Here, especially glues that consist of water-soluble, animal (glutin, casein), vegetable (starch, dextrin, cellulose ether) or synthetic (polyacrylic acid derivatives, polyvinyl alcohol, polyvinyl pyrrolidone) polymers and water as solvents are suitable as cements. The latter belong to the class of single-component cold-setting cements in which the solvent (water) during the process of cementing is absorbed or evaporated. These glues harden as they cool, especially in a gelatin-like manner, and generally dry to a transparent mass that dissolves into a gel with high adhesive strength upon contact with water.

It is preferred when a cement that is dispersed in water or processed with water or a glue is applied as a cement bead and is dried in situ or at the factory. By the consumer applying water directly to this dried cement layer or by indirect intense contact with water that has been applied to the panel to be joined or its groove or tongue or by penetrating moisture, the dried cement is activated after the panels are joined to one another and returned into the active, adhesion-ready state. The application of the aqueous activator can take place by spraying or applying by means of a sponge or the like.

In one advantageous approach, first the cement beads are moistened with water, or a water film that at least wets the cement bead is applied or sprayed onto the tongues and/or into the grooves of the panels, and then the panels are joined to one another. The exposed time of the reactivated cement is chosen such that there is enough time for joining the panels to one another.

If the bead or strip is made of plastic, this embodiment has the advantage that the groove and the tongue can be easily locked to one another; if the bead or strip is formed from a cement, locking can take place accompanied by cementing.

It is advantageous if the features of claim 4 are implemented. In such an execution of the tongue and groove, the cohesion of the two cladding panels to be joined is improved and a coating with an essentially considerable stiffness is achieved. In this case, the cement of the cement beads can support the especially intimate connection between the groove and the tongue.

It is advantageous if the features of claim 6 are satisfied. In this way, the danger of damage or shearing-off of the cement beads or plastic beads when the tongue is inserted into the groove is reduced and their support on the surface to which the bead adheres is increased. Also, in this connection, it is advantageous if the cement bead adheres strongly in its recess and/or on the wall surfaces of the groove and/or the tongue surfaces. This strong adhesion is not to be entirely lost even when the cement is activated by contact with water; in particular this adhesion is to be made as strong as possible. The beads advantageously need project only slightly out of the recess.

Advantageously it is provided that the groove and the tongue are each made lengthwise or in one lengthwise side and/or lengthwise and in one transverse side of a panel, optionally the tongue and/or the groove and/or the beads or strips extending over the entire length of the respective side surface. Thus, optimum connectability and optimum coherence are achieved over all of the sides of the cladding panels during installation with the cladding panels to be connected.

The connection of the panels to be joined becomes simple when the features of claim 7 are used; joining of the flat surfaces is possible with little expenditure of force; it is simply necessary to overcome the elevations formed by the applied beads in order to insert them into the recesses. To do this, it is provided according to the invention that at least one leg, preferably the lower leg, of the groove can be widened or elastically bent up when the tongue is inserted and/or the plastic and/or cement used has the corresponding elastic behavior or viscosity.

The elastic widening of the legs of the groove undertaken by the locking cement beads can be partially, largely or completely cancelled again in the course of activation of the softening cement; thus the cross-sections of the cement beads can to a certain extent overlap. In this respect, the features of claim 19 are advantageous.

It is provided according to the invention that the cement of the cement beads or strips be water-soluble or upon contact with or supply of water and/or moisture can be partially dissolved and/or activated and/or formed by water-soluble glue, e.g., white glue, and/or by a pressure cement or a cement that can be activated by pressure or that develops an adhesive action when pressure is applied.

It is furthermore provided according to the invention that the panel is formed from wood material, MDF, HDF, plastic, recycled plastic, chips or chips bonded with resin (particle board) and optionally on its front surface or useful surface and/or on its back is provided in each case with at least one coating, e.g., a decorative coating, especially of plastic, decorative paper, wood, or the like.

The cross-sectional shape of the bead can be selected in a variety of ways; it is advantageous if the bead or strip and/or the recess and/or the recess in cross-section has a shape that is semicircular, lens-shaped, elliptical or elongated-rectangular, the transitions running rounded or bevelled from the plane surfaces to the beads.

Good coherence of two panels that are to be connected or of the groove and tongue arises when the features of claim 16 are implemented. In such an embodiment, the cement bead is in good contact with the parts that are to be joined, specifically the tongue and groove of two panels that are to be connected.

It is especially advantageous if according to the invention the features of the characterizing part of claim 10 are satisfied. In this way, the beads perform a double function, specifically they act as a locking element and as an element for connecting two panels.

The features of claim 29 are advantageous. With such a component that is designated an external tongue, it is simply necessary to mill out grooves on the peripheral surfaces of a panel; the components can be quickly produced in large amounts. The components are joined to the panels in part at the factory or this remains for the user to do.

In one especially advantageous embodiment of the invention the grooves and tongues are not aligned perpendicular to the side surfaces of the panels, but run perpendicular to the surface of the panels. Thus, locking of the groove and tongue when the panels are installed can take place by movement that takes place perpendicular to the panel surface. Regardless of this, all the advantages of the above-described tongue-in-groove connection possibilities can be used or provided.

The invention is explained in more detail below using the drawings that constitute, for example, schematic embodiments of the invention.

Figure 14:
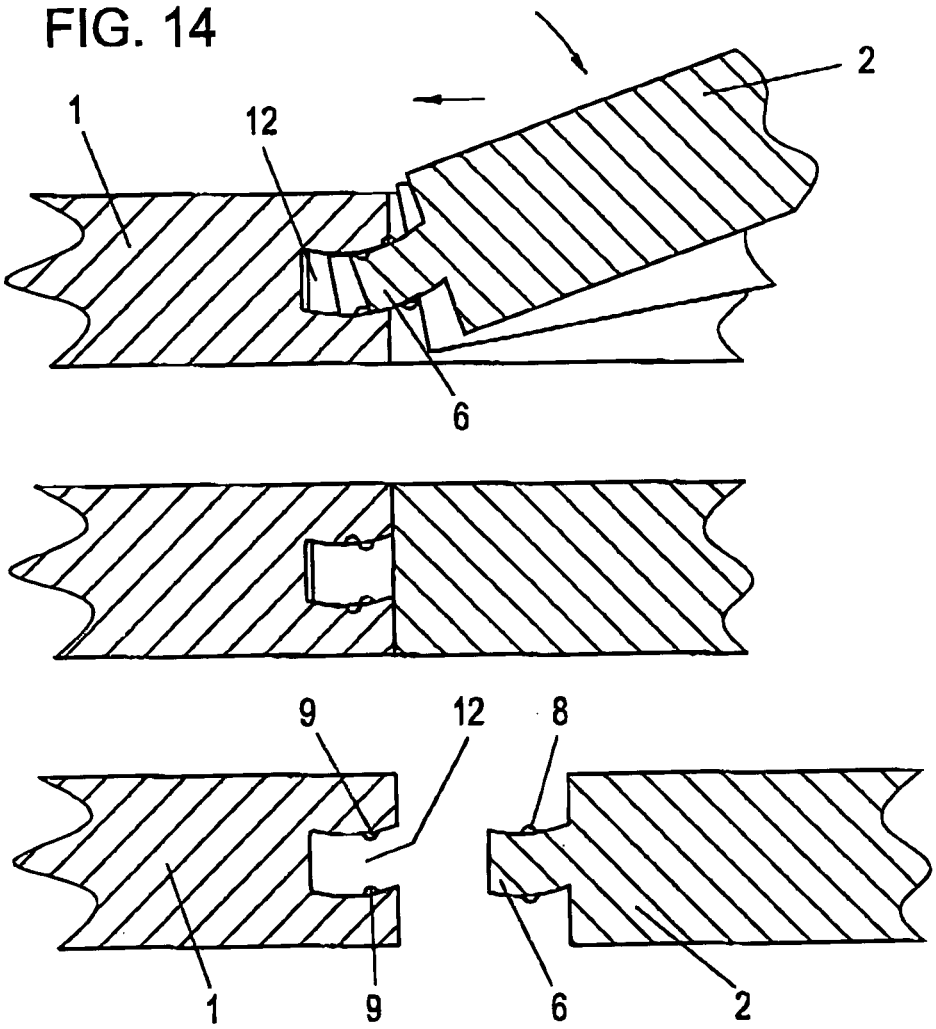
Figure 15:
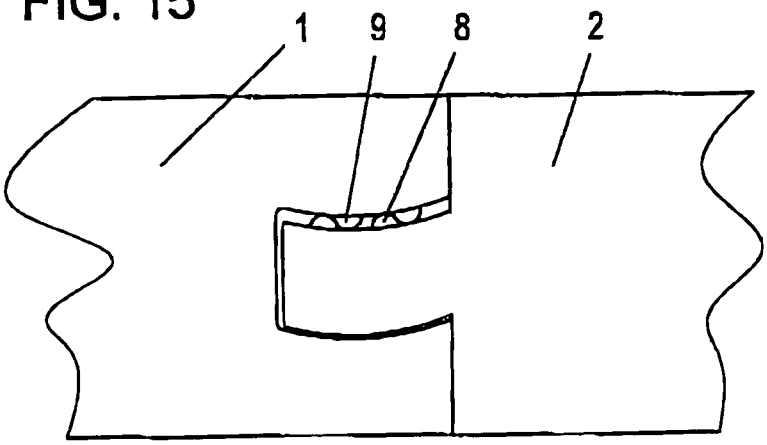
Figure 16:
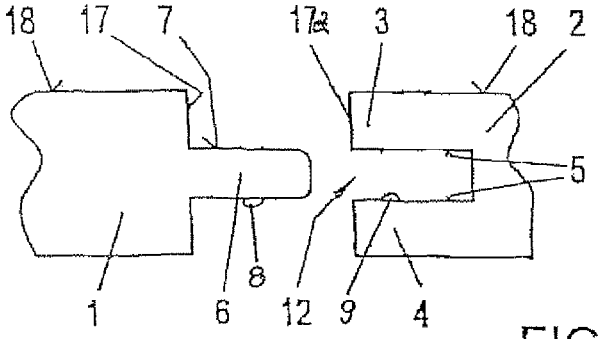
Figure 16A:
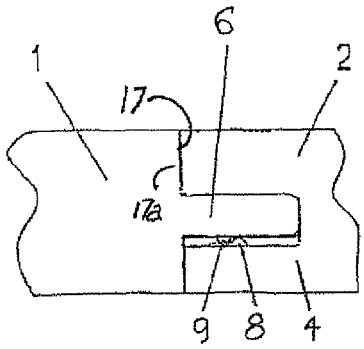

FIGS. 1, 1*a*, 2 to 8 and 8*a* show schematic sections through cladding panels; FIG. 9 schematically shows the joining of two cladding panels to one another; FIG. 10 and FIG. 10*a* show sections of beads; FIG. 11 shows one embodiment of the invention in which the tongue is made in the form of an "external" tongue and is inserted into the grooves of adjacent panels or panels that are to be joined; FIG. 12 shows one especially advantageous embodiment of the invention. FIG. 13 shows the dimensions of a bead. FIGS. 14 and 15 show further embodiments of the invention while FIGS. 16 and 16*a* show beads only on the bottom surface of the tongue and bottom leg of the groove.

FIG. 9 schematically shows two cladding panels 1, 2 that are to be moved onto one another in the direction of the arrow 20 and joined to one another. This joining that takes place by movement can or should take place as the last connection step only in the plane spanned by the two panels 1, 2. The two panels on their lengthwise sides and/or narrow side each have a tongue 6 that projects from the end face 17 and on the opposing lengthwise side and/or narrow side have a groove 12 that is made in the end face 17. The same conditions can prevail on the end faces 17 of the narrow sides; each of the panels 1, 2 can each have one groove 12 and one tongue 6 on the end face 17 of these narrow sides.

The shape of the groove and the shape of the tongue are matched to one another in order to ensure a good connection between the groove and the tongue. This shape allows the tongue 6 to be inserted into the groove 12 when the panels 1, 2 are aligned in the plane of the panel. It is possible to connect the panels 1, 2 in a checkerboard manner or offset against one another. Both the connection on the lengthwise sides and also on the narrow sides takes place by displacement essentially in the plane that is spanned by the panels 1, 2. The type of connection according to the invention could also be provided only on the transverse and narrow sides of panels that are connected on the lengthwise side in some other way, e.g., by swivelling or pivoting the panel to be connected.

FIG. 1 schematically shows through two panels 1, 2 that are to be joined. The panel 1 has a tongue 6 with an insertion area 6*a* extending to a free end 6*b* that is inserted into a groove 12 of the panel 2 until the first and second end faces 17 and 17*a*, respectively, adjoin one another in the top area or in the area that is near the surfaces 18 and 18*a* of the panels 1, 2. The bordering edges of the groove 12 and/or the tongue 6 can be rounded or beveled.

Figure 1A:
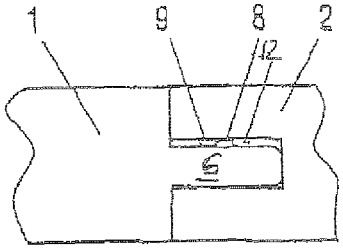

On at least one tongue surface, in this case the tongue surface 7 near the surface, a bead 8 is applied or adheres especially securely to the tongue surface 7. At the corresponding or assigned location of the wall surface 5 of the groove 12 or of the leg 3, which wall surface is near the surface, when the panels have been joined, another bead 9 that is matched to the location of the bead 8 is formed in the otherwise preferably flat wall surface 5. When the two panels 1, 2 are joined or when the tongue 6 is inserted into the groove 12, the bead 8 comes to rest in the area behind the bead 9 or can lock with this other bead 9. The bead 8 has a rear surface 8*a* which is disposed behind a rear surface 9*a* of the second bead 9 so that the rear surfaces 8a and 9*a* face one another as seen in FIG. 1*a*. This mechanically locks the panels 1 and 2 together. The beads 8 and 9 are adhered to the wall surfaces 7 and 5, respectively, by interfaces 8*c* and 9*c*, respectively. The rear surfaces 8*a* and 9*a* are located from the first and second end faces 17 and 17*a* by first and second distances which at least approximate one another, wherein the rear surfaces 8*a* and 9*a* face one another to mechanically lock when the tongue (6) is inserted in the groove (12). Since the rear surfaces 8*a* and 9*a* are made of adhesive, the rear surfaces also adhere to one another.

It is advantageously provided that the cement of at least one of the cement beads or strips 8, 9 is water-soluble or upon contact with or supply of water and/or moisture can be partially dissolved and/or activated and/or is formed by water-soluble glue, e.g., white glue, and/or by a pressure cement or a cement that can be activated by pressure and that develops an adhesive action when pressure is applied. The cement of the cement beads 8, 9 can be activated by wetting the cement beads 8, 9 with water before joining the panels 1, 2 or by delivering water to the groove 12 and/or the tongue 6. Depending on the choice of the cement, it can also be provided that after locking of the cement bead 8 with the bead 9 by the atmospheric humidity that penetrates in the use of the panels 1, 2, the adhesive capacity of the cement beads 8, 9 is activated and thus an adhesive connection between the tongue 6 and the leg 3 of the groove 12 is produced. Fundamentally, cements can also be used that can be activated with substances other than water.

For joining the panels 1, 2 in this case for insertion of the tongue 6 provided with the bead 8 into the groove 12, it is provided according to the invention that at least one leg 3, 4 of the groove 12 can be elastically widened or elastically bent up when the tongue 6 is inserted.

Fundamentally, it is possible to form at least one or more bead(s) 8 or 9 that lie parallel next to one another on one or both tongue surfaces 7 or on one or both wall surfaces 5 of the groove 12. It must simply be watched that to each bead 8 is assigned a corresponding other bead 9 at the corresponding location in the wall opposite it, so that these two beads 8, 9 can lock, as is shown in FIG. 1*a*.

Figure 2:
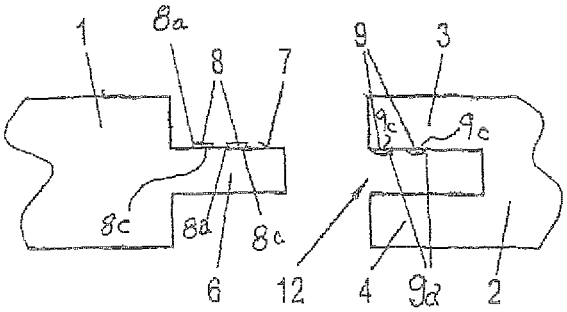

Accordingly, in FIG. 2, two beads 8 applied to the tongue 6 are made; at the corresponding site on the wall surface 5 of the groove 12, two other beads 9 correspond to these beads 8. In this way, the cementing and/or the locking of the groove and tongue can be improved.

Figure 3:
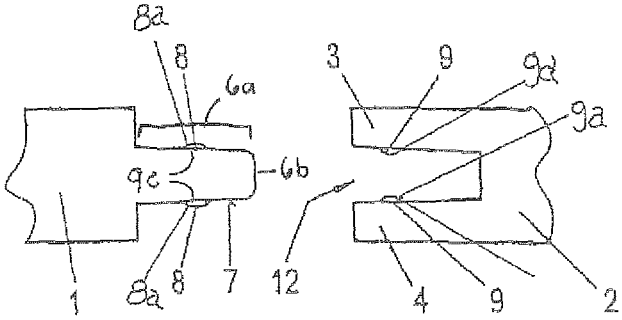
Figure 7:
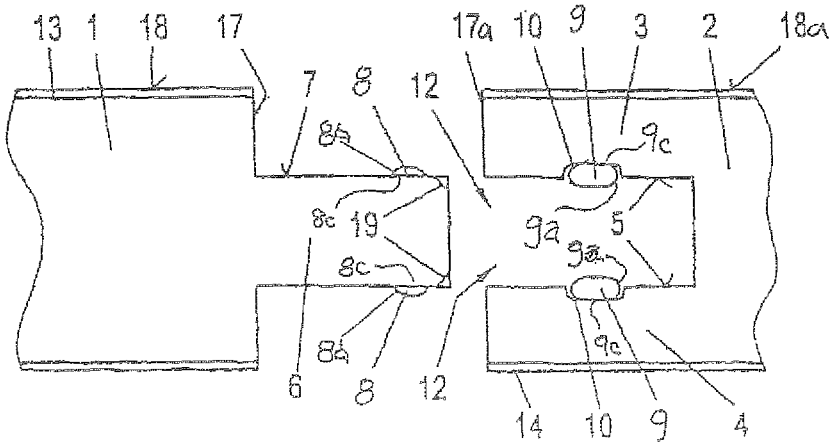

In one embodiment of the invention according to FIG. 3, it is provided that the two tongue surfaces 7 converge toward the free end of the tongue 6 and that the wall surfaces 5 of the groove 12 are tilted at the same angle as the tongue surfaces 7 and converge to the inside.

It can apply to this and also to all other embodiments that advantageously the tongue 6 and the groove 12 can be connected at least over one part or optionally over the entire insertion area(s) of the tongue 6 by positive connection or with a snug fit and/or that the area of the tongue 6 that lies in front of the bead toward the free end of the tongue 6 can be inserted by a positive connection or with a snug fit into the groove 12. In all embodiments, it can be provided that the tongue 6 and/or the groove 12 and/or the beads 8 and 9 extend over the entire length of the respective side surface 17, and/or that the beads 8 and 9 and optionally the recess 10 (FIG. 8) extend continuously over the length of the groove and/or of the tongue 6 or are made or applied in the form of individual successive sections. The beads 8 and 9 are in the form of strips in that the beads have a longitudinal extent.

As the material for the panels according to the invention, it is advantageously provided that the panel 1, 2 is formed from wood, wood material, MDF, HDF, plastic, recycled plastic, chips with synthetic resin or bonded chips (particle board) and optionally is provided on its front or useful surface and/or on its back in each case with at least one coating 13, 14, e.g., a decorative coating, especially of plastic or decorative paper. Furthermore, it can be advantageously provided that the groove 12 and the tongue 6 are made from the material of the panels 1, 2 or are milled out of them, or that the tongue 6 is formed integrally with the material of the panels 1, 2. For all embodiments and also in the embodiment according to FIG. 3, it can be provided that the bead(s) 8 can be locked to the assigned other bead(s) 9 in the tongue 6 and/or in the groove 12 and the bead(s) 9 8 and the other bead(s) 9 interact as locking elements.

Figure 4:
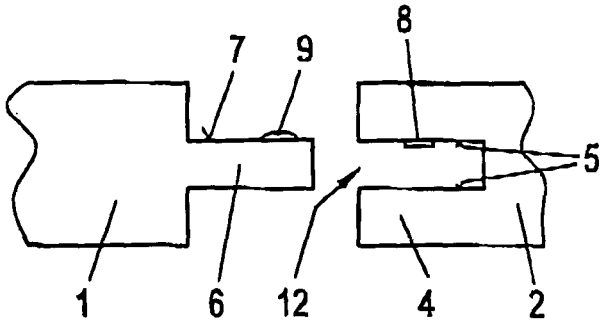

In the embodiment according to FIG. 4, it is provided according to the invention that on one wall surface 5 of the groove 12, a bead 8 that has a somewhat rectangular cross-section is formed; a lens-shaped bead 9 is formed at the corresponding position on the tongue surface 7. Thus, both locking and also cementing of the two panels 1, 2 that are to be joined to one another become possible.

Figure 5:
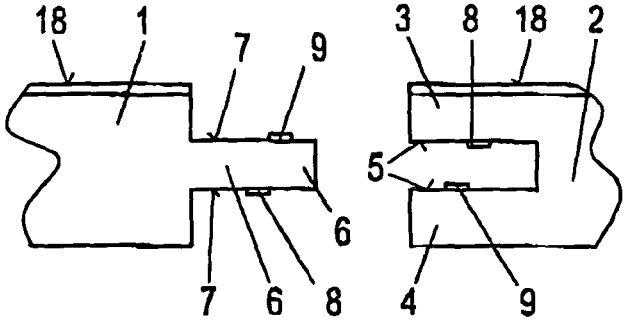

In one embodiment according to FIG. 5, it is provided that on the tongue surface 7 near the surface, a bead 9 is formed, and that on the tongue surface 7 away from the surface a bead 8 is applied. Accordingly, one bead 8 is formed on the wall surface 5 of the leg 3 of the groove 12 near the surface, and another bead 9 is formed on the wall surface 5 of the leg 4. As FIG. 5 also shows, in each case the bead 8 and the other bead 9 are assigned positionally to one another in order to enable the corresponding locking and optionally cementing.

Figure 6:
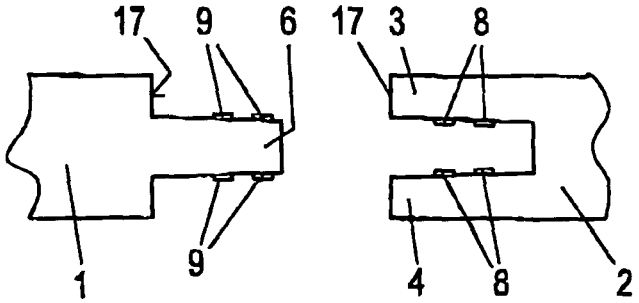

In the embodiment according to FIG. 6, it is provided that on each tongue surface 7, in each case two other beads 9 at a time are made at a distance from the end face 17 of the panel 1; accordingly, on the two wall surfaces 5 of the legs 3 and 4, in each case two beads 8 are formed at a corresponding interval or at the corresponding distance from the end face 17 of the panel 2.

It can be provided according to the invention that some of the bead or strip 8 and 9 is arranged countersunk in a recess 10 that is made in the wall surface 5 of the groove 12 and/or in the tongue surface 7. At the same time, the recess 10 helps the applied bead 8 or 9 to be joined securely to the respective wall surface and not to be sheared off when the tongue 6 is inserted into the groove 12. As shown in FIG. 10, the beads 8, 9 can also be extended over the recess 10 onto the surfaces 5 or 7. As shown in FIG. 13, the recesses 10 can also have areas 20 that are free of bead material and in any case are filled with bead material when the latter softens in the cementing process.

The panels 1, 2 can be provided with coats 13 or 14, e.g., of wood, plastic, paper or the like, in order to configure the useful surface or bottom surface accordingly. These supports, however, do not have any effect on the connecting technique according to the invention.

The selected cross-sections of the beads 8 and 9 and of the recesses 10 are optional; the region of the bead 8 or 9 that projects out of the recess 10 or over the wall surface 5 of the groove 12 or the tongue surface 7 is held by the recess 10 especially during cementing or softening or comes into contact with its surfaces and optionally cements the tongue 6 to the legs 3, 4 of the groove 12. The cross-sectional shape of the recess 10 can be oblong, rectangular, triangular, lens-shaped, triangularly elliptical or the like.

Fundamentally, at least as shown in FIG. 8*a*, the bead 8 could also be formed by a series of individual beads lying directly next to one another. In this case, there can be the corresponding shaping of the beads 8, 9 and/or the corresponding water application for the cement bead 8, 9 or this cement bead is partially dissolved accordingly so that the latter can soften sufficiently.

It is to be generally avoided that the legs 3, 4 of the groove 12 that are elastically widened when the tongue 6 is inserted into the groove 12 remain in the widened position. In the widened state, the joint 16 between the surfaces 18 of the two panels 1, 2 could form a step that would be subjected to increased wear, provided that not only the lower leg remains elastically widened. In one especially advantageous embodiment of the invention, it is provided that the leg 3 of the groove 12 that is near the surface is made more or less elastic, especially inelastic anyway, and only the leg near the bottom or the lower leg of the groove is made able to deflect elastically. Thus, it can be avoided that the upper leg 3 near the surface will be bent up by more or less deformable beads 8, 9, but only the lower, weaker or thinner leg 4 of the groove 12 is bent down. To prevent the upper leg 3 of a groove 12 from bending up, it can also be advantageously provided that the bead(s) 8, 9 is (are) made simply on the tongue surface 7 that is pointed down and on the wall surface 5 of the lower leg 4 of the groove 12. In this way, both the tongue 6 and also the upper leg 3 of the groove 12 would counteract the arching of the connecting site if the extent or the volume of the bead is made too large or, when a cement is used, the latter is not made soft enough and/or the volume stipulated for it between the groove and tongue is not made large enough.

The shape of recess 10 can be lens-shaped, triangular, semi-elliptical or oblong-rectangular. It is provided that this recess 10 is made as a depression in the otherwise flat tongue surface 7 or the flat wall surface 5 of the groove 12. Thus, the cement application or the amount of plastic for the beads 8, 9 should be defined or limited to certain areas.

Figure 8:
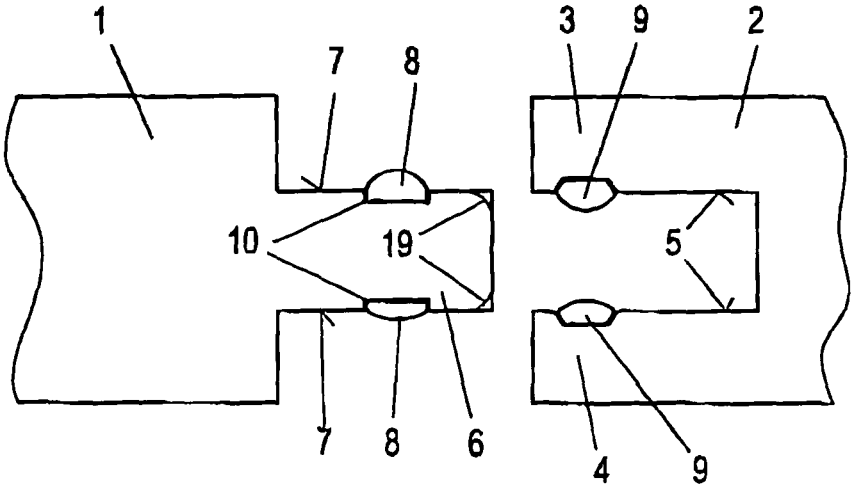

In an embodiment of FIG. 8 according to the invention, it is provided that in the tongue surfaces 7 of the tongue 6, recesses 10 are made that each accommodate one bead 8. In this case, the two beads 8 can have different cross-sections. It is quite possible to make the beads different that are located in the two wall surfaces 5 of a groove 12 or on the two tongue surfaces 7 of a tongue 6. In the case of FIG. 8, the bead 9 that is made in the leg 3 is larger than the recess 9 that is made in the leg 4.

Advantageously, the beads 8, 9, as shown in FIG. 10*a*, are triangular in cross-section with a rounded edge in order to lock well onto one another. The flank angles are between 30 to 60°, especially between 40 and 50°. If or as long as no cementing action occurs, the joint can also be separated.

It can be advantageous if the front edge areas of the tongue 6 have rounding or bevelling 19 as is shown in FIG. 1, 3 or 7 and 8 in order to push the legs 3, 4 or the beads 8, 9 apart from one another as carefully as possible when the tongue 6 is inserted into the groove 12.

In principle or in all embodiments, the tongue 6 can have rounding 19 directly in front of the beads 9. Thus, it also becomes possible to make the tongues 6 shorter and the groove 12 less deep. The joint 16 in the area of the panels 1, 2 that is near the surface is made such that the areas of the end face 17 that is near the surface adjoin one another and a gap is avoided as far as possible. In the area of the panels 1, 2 that is away from the surface or near the bottom, it is provided that the end faces 17 do not touch one another or that a gap 15 is formed between them. This is achieved especially in that the leg 4 of the groove 12 near the bottom is made slightly shorter than the leg 3 near the surface.

It is generally advantageous if the beads or strips 8, 9 are applied roughly in the middle or in the middle area on the tongue surface 7 or on the wall 5 of the groove 12 or of the legs 3, 5.

FIG. 13 incorporates different dimensions of the beads, especially a cement bead 8, 9, and of the groove 12. Using this figure, some data with respect to advantageous embodiments of beads, especially cement beads, are given.

It can be provided according to the invention that the width B of the bead or strip 8 or 9 is one to nine times, preferably one to seven times, especially two to five times, as great as its height H. Furthermore, according to the invention, it can be provided that the cement bead or strip 8, 9 comprises an adhesive-latent cement material, preferably a polymer cement that can be emulsified with water, and the cement material can be converted into the adhesive-ready or adhesive state by wetting with water, and/or that the plastic or the cement material of the cement bead or strip 8 and 9 that can be (re)activated by means of water or moisture is applied with an essentially uniform layer thickness of 0.1 to 0.6 mm, especially from 0.2 to 0.5 mm, at thickness tolerances in the range from ±0.05 to 0.1 mm, and/or that the cement of the cement bead or strip 8 is formed by a quick-setting or mounting glue based on polyvinyl acetate, such as, for example, DORUS MDO 55 from the Henkel Company, or a commercial wood glue, e.g., based on starch and protein. It can be advantageous if the width B of the cement bead or strip 8 corresponds to 5 to 25%, preferably 9 to 21%, especially 12 to 17%, of the thickness D of the groove 12.

It should be noted that the attachment of the beads 8, 9 to the corresponding surfaces 5, 7 can take place either directly on these surfaces 5, 7 or in the recesses 10 that were made in the especially flat surfaces 5, 7. Advantageously, the applied beads 8, 9 project roughly 0.1 to 0.2 mm over the respective surface 5, 7.

Advantageously, the tongue 6 on each tongue surface 7 bears a bead 9 and on each leg 3, 4 of the groove 12, a cement bead 8 is optionally applied in a recess 10.

The important action of the applied beads 8, 9 consists in their locking action that is used especially in the course of installing and matching of the panels to be joined.

When the edges of the free end of the tongue 6 are rounded accordingly and/or the inner edges of the wall surfaces 5 of the legs 3, 4 of the groove 12 are rounded, it is also possible during installation to first lay the panels 1, 2 to be joined to one another at a certain angle on one another in order to attain entry of the tongue 6 into the groove 12 to a certain extent. The final locking of the tongue 6 and the groove 12 or the last interlocking step that ends with contact of the end faces 17 in the area near the surface is in any case only possible when the panels 1, 2 are moved relative to one another in the plane of the panels.

Care should be taken that the cement is softened or becomes soft accordingly so that no unevenness is formed in the joint area of the panels 1, 2 that are to be joined to one another. The amount of cement to be applied in the cement beads 8, 9 depends mainly on the geometrical circumstances between the tongue 6 and the groove 12 or on the size of the recesses 10 and especially also on the viscosity of the reactivated cement.

FIG. 11 shows one embodiment of the invention in which the tongue construction is made such that the side surfaces 17 on which a panel 1, 2 should have a tongue, which is designed to interact with a groove of a panel that is to be joined, are made such that first a groove 12 is also formed there into which a tongue 6' of an independent component can be inserted. This tongue 6' is an independent component instead of the tongue 6 described in the figures and the description and the claims and is connected or can be connected to one of the panels 1, 2, optionally at the factory. The tongue 6' is made along its two sides like a tongue 6 and is made on both sides such as is described in conjunction with the description, the drawings and the claims for a tongue 6. It can be provided that the tongue is made as a mirror image. With one side, the tongue 6' is inserted into a groove of the panel 1 and with its other side (during installation) into a groove of the panel 2. The beads 8 and 9 on the tongue surface 7 lock with the beads 8 and 9 in the legs 3, 4 of the respective grooves 12.

The component 6' constitutes a double tongue 6. The advantage of this so-called external tongue is that the panels 1, 2 can be made solely with the corresponding grooves 12 all around on their side surfaces and the external tongues 6' can be inserted into the grooves 12 at the factory or just during installation. The insertion of an external tongue 6' also takes place in the plane of the respective panel 1, 2. The panels 1, 2 are also joined when the external tongues 6' are inserted at least in the last joining step by displacement in the plane of the panel.

All statements regarding the tongues 6 apply both to the left part and also to the right part of the component 6' that is shown in FIG. 11.

FIG. 12 shows one embodiment of the invention in which the grooves 12 are not made perpendicular to the side surfaces 17, but rather run perpendicular to the surface of the panels 1, 2, i.e., turned by 90°. The groove area A is built up or designed in the same manner as grooves 12, which are described in FIGS. 1 to 11 or the pertinent description and the pertinent claims. A tongue 6 interacts with this groove 12 and likewise corresponds to the tongues 6, as the latter were described in the previous FIGS. 1 to 11 as well as in the previous description and claims. The tongue 6 can likewise be regarded as turned by 90°. The area A thus represents nothing other than the connecting area of a tongue 12 with a groove 6 that has long been described, only that in this case the groove 12 and the tongue 6 run perpendicular to the surface of the panel 2. Therefore a connection of the panels 1, 2 takes place not only by displacement in the plane of the panel, but by displacement perpendicular to the surface of the panels 1, 2. It is not easily possible to swivel the panels in; in the final step of joining, a linear movement perpendicular to the plane of the panel takes place.

As already described above in conjunction with FIGS. 1 to 11, the beads 9 and the beads 8, especially cement beads, are made on the wall surfaces 5 of the groove 12 and/or on the tongue surfaces 7 in order to effect mutual locking of the groove 12 with the tongue 6 and in any case mutual cementing.

Furthermore, the area B can also be defined as a groove area that has been turned by 90° and that is formed in the panel 2 in the sense of the preceding description and FIGS. 1 to 11 and the claims. The leg 4 of this groove area B interacts, on the one hand, as a tongue 6 with the groove 12 of the area A; the leg, on the other hand, however, also with the body 31 of the panel 2, forms a groove 12' into which the leg 4 of the area A can be inserted. One or both sides of the leg 4 can be provided with beads 8 and 9 that interact with beads 8 and 9 that are made in/or on the wall surfaces 5' of the groove 12'. The design of such beads 8 and the other beads 9 in the groove 12 and/or on the tongue 6 was already described in detail in the preceding description.

If it is provided that the panel 2 in its side end area ends with a boundary surface 30 at a distance from the outside leg 4 of the groove 12 in order to facilitate joining of the panels 1, 2, the corresponding beads 8 and 9 are provided simply on the tongue 6 that can be inserted into the groove 12 of the area A of the panel 1.

The leg 3 of the groove 12 in the panel 1 is integrated into the panel body of the panel 1 or is represented by the panel body.

The beads 8 and 9 can also be located in recesses 10 here; however, such recesses 10 are not indicated in FIG. 12. The above-described cements and/or plastics are used for the beads 8 and 9.

The grooves 12, tongues 6 and recesses 10 are preferably produced by milling.

The shape of the grooves 12 and the tongues 6 are advantageously matched to one another, but this is not absolutely essential. Grooves and tongues that have not been matched to one another in terms of shape can also be held together with the beads 8, 9 provided according to the invention.

The beads 8 and/or 9 can also be applied in the form of successive partial pieces, i.e., optionally with interruptions.

It is advantageous if at least one bead extends parallel to or along the edge of the end face 17 or in the lengthwise direction of the panel 1, 2. Fundamentally, the path of the bead, optionally dictated by production or by intention, can deviate from a parallel course with respect to the lengthwise extension of the panel.

FIG. 14 shows cladding panels 1, 2 that can be connected to one another by swivelling and by simultaneously bringing them together. According to FIG. 14, bottom, one panel 1 on at least one side surface has a groove 12 with inside surfaces that run curved. The tongue 6 of the panel 2 that is to be joined has tongue surfaces with a curvature that is matched to the curvature of the groove side surfaces 5. Furthermore, the thickness of the tongue 6 corresponds to the width of the groove 12 or is slightly less than the latter.

In this case, the tongue on its tongue surfaces bears at least one bead or strip 8 that can be locked to at least one other bead 9 on the groove side surfaces 5, as is shown in FIG. 15.

The mutual connection of the panels 1, 2, as is shown in FIG. 14, bottom, takes place as shown in FIG. 14, top. The panel 2 to be connected is attached obliquely to the already installed panel 1 and the end area of the tongue 6 is inserted into the groove 12. Thereupon, the attached panel 2 is lowered or swivelled down, the tongue 6 being inserted into the groove 12. At the same time, the panels 1, 2 are brought together. In the final stage of the connecting motion, the beads 8 lock with the other beads 9 and support the prepared connection. FIG. 14 schematically shows three positions of the panel 2 that is to be connected. In the uppermost position that is made cross-hatched, the panel to be connected is in a position in which the tongue 6 is inserted into the groove 12 to a certain extent. As the attached panel 2 continues to swivel down, as can be seen from the illustrated middle position, the tongue 6 penetrates deeper into the groove 12 until in the connected position, at least the front areas of the panels on the surface side lie against one another and the tongue 6 is held by the groove 12 such that the beads 8 interact or lock with the other beads 9, as is shown schematically in FIG. 15.

It is advantageous here if the radii of curvature of the inside surfaces of the groove 12 and of the surfaces of the tongue 6 are made the same size, or the thickness of the tongue 6 corresponds to the width of the groove 12 or is kept somewhat smaller.

In FIG. 16 and FIG. 16*a* the bead 8 is on the bottom surface 7*a* of the tongue 6 and the bead 9 is on the bottom surface 5*a* of the leg 4 of the groove 12.

It is quite generally advantageous if the beads 8 and 9 are directly opposite one another with respect to the tongue 6 and the groove 12.

It is possible to make several beads 8 and other beads 9 interacting with one another on the curved tongue surfaces and on the curved groove side surfaces.

It is furthermore possible for the tongue surfaces and the side surfaces of the groove 12 to have straight and curved segments, the straight segments not preventing or allowing swivelling of the attached panel 2 when two panels 1, 2 are being joined.

Quite generally, the beads 8 and the other beads 9 extend behind one another, or the beads 8 on the tongues 6 extend behind the other beads 9 in the groove 12. The location of the beads 8 and of the other beads 9 on the tongue surfaces and the side wall surfaces of the grooves 12 is chosen accordingly. The beads 8, 9 that extend behind one another adjoin one another or can be connected to one another.

The other beads 9 on the wall surfaces of the groove 12 hold the beads 8 securely on the tongue surfaces and thus in the groove 12.

When the tongue 6 is inserted into the groove 12, the groove legs can be slightly, optionally permanently, widened or bent up.

The catch function of the beads 8 and the other beads 9 is essentially the same when they are being inserted and pivoted in.

In particular, in FIGS. 1*a*, 12 and 15, the beads 8, 9 and the catch gap between the tongue 6 and the groove wall surface were shown overdimensionally large and not to scale, but only schematically in order to explain the locking.

All features relating to the panels that can be joined for insertion in a plane can also be implemented for panels that can be joined by swivelling. This relates especially to the materials as well as the shape and position of the beads.

The invention claimed is:

1. A cladding panel , the cladding panel being made from wood, wood material, MDF, HDF, plastic, recycled plastic, chips with synthetic resin or bonded chips, and being configured for cooperation with similar cladding panels to form floors, walls and ceilings, the cladding panel comprising:

a first edge (17) having a tongue (6) with an insertion area (6*a*) extending to a free end (6*b*) associated therewith and a second edge (17*a*) having a groove (12) defined between opposed legs (3) and (4), the tongue (6) and groove (12) having opposed wall surfaces (7) and (5) associated therewith, the cladding panel (1), being joinable with adjacent similar cladding panels (2) upon receiving a tongue (6) of a similar cladding panel in the groove (12) and upon inserting the free end of the tongue (6) into the groove (12) of another similar cladding panel (2) to form floors, walls or ceilings, the panels (1, 2) each having top surface areas (18), (18*a*); the tongue (6) and groove (12) being disengageable when the tongue is inserted (6) into the groove (12);

at least one first deposited bead (8) having an interface (8*c*) with and adhered to the wall surface (7) of the tongue (6), the first bead (8) having a rear surface (8*a*) spaced a selected first distance from the first end face (17);

at least one second deposited bead (9) having an interface (9*c*) with and adhered to a wall surface (5) of the groove (12), the wall surface (5) being on at least one of the opposed wall surfaces (5) of the legs (3,4) forming the groove (12), the second bead (9) having a rear surface (9*a*), spaced a selected second distance from the second end face (17*a*), which first and second selected distances at least approximate one another wherein the rear surfaces (8*a*) and (9*a*) face one another to mechanically lock the tongue (6) within the groove (12) when the tongue (6) is inserted into the groove (12);

at least one of the first and second beads (8 and 9) being comprised entirely of an adhesive, the adhesive comprising an adhesive cement, adhesive plastic or an adhesive composite of cement and plastic; the first and second beads being adhered to one another upon the panels (1 and 2) being joined;

the first bead (8) being positioned at a first location on the outer surface (7) of the tongue (6) and the second bead (9) being positioned at a second location on the inner surface (5) of at least one leg (3, 4) of the groove (12); wherein when the tongue (6) of the cladding panel (1) has been inserted into the groove (12) of an adjacent similar cladding panel (2) to bring the edges (17) and (17*a*) into proximity, the first bead (8) has passed over the second bead (9) thereby positioning the first bead (8) behind the second bead (9) with the rear surface (8*a*) of the first bead (8) facing the rear surface (9*a*) of the second bead (9) and with the edges (17) and (17*a*) in proximity to mechanically lock the tongue (6) within the groove (12), and wherein when the cladding panel (1) receives in the groove (12) the tongue (6) of a similar cladding panel (2), the first bead (8) on the tongue (6) of the similar cladding panel passes over the second bead (9) on the cladding panel (1) and by simultaneous mechanical and adhesive contact therebetween while the beads (8) and (9) are within the groove (12) holds the tongue (6) within the groove (12) of the cladding panel (1), whereby a surface (18), (18*a*) is configured that is further extendible by still additional similar cladding panels, and wherein the beads (8 and 9) of the cladding panel have been deposited on the outer wall surface (7) of the tongue (6) and on the inner wall surface (5) of the groove (12) during manufacture of the cladding panels (1 and 2) prior to delivery of the cladding panels (1 and 2) from a facility making completed panels.

2. The cladding panel according to claim 1, wherein the groove (12) and the tongue (6) are each located on one lengthwise side and on one transverse side of a panel (1, 2), respectively, and in and on the edge (17) of the panel (1, 2), respectively.

3. The cladding panel according to claim 1, wherein at least one tongue surface (7) converges at an angle toward the free end of the tongue (6) and runs parallel to the surface (18) of the panel (1, 2), and wherein at least one wall surface (5) of the groove (12) is tilted at the same angle as the adjoining tongue surface (7) and diverges to the outside and parallel to the surface (18) of the panel (1, 2).

4. The cladding panel according to claim 1, wherein the tongue (6) and the groove (12) are connected at least over one part of the entire insertion area of the tongue (6);

at least the area of the tongue (6) that lies in front of the bead (8) toward the free end of the tongue (6) being inserted with a snug fit into the groove (12).

5. The cladding strip of claim 4 wherein there are at least two first beads (8) spaced from one another and at least two second beads (9) spaced from one another, being located on surfaces of the tongue (6) and the groove (12), which surfaces face one another with each first bead (9) being behind at least one second bead (9).

6. The cladding strip of claim 5 wherein the first beads (8) are on the same surface (7) of the tongue (6) and the second beads (9) are on the same leg (3) of the groove (12).

7. The cladding panel of claim 5 wherein the first beads (8) are on oppositely facing surfaces (7) of the tongue (6) and the second beads (9) are opposed inner surfaces (5) on the legs (3 and 4) forming the groove (12).

8. The cladding panel according to claim 1, wherein the tongue (6) or the groove (12) or the beads (8) and (9) extend over the entire length of the respective edge (17), wherein the bead (8) or the bead (9) extend lengthwise over the side surface (17) in the form of successive, spaced bead sections.

9. The cladding panel according to claim 1, wherein part of the bead (8) or the bead (9) are countersunk in a recess (10) that is made in the respective wall surface (5) of the groove (12) or the respective tongue surface (7).

10. The cladding panel according to claim 9, wherein the wall surfaces (5) of the groove (12) or the tongue surfaces (7) are planar with the recesses (10) comprising depressions in the plane surfaces (5, 7).

11. The cladding panel according to claim 9, wherein the bead (8) or the other bead (9) and the recess (10) extend continuously over the length of the groove of the tongue (6) and are made or applied in the form of individual successive sections.

12. The cladding panel according to claim 9, wherein the bead (8) or the other bead (9) and the recess (10) in cross-section have a semicircular, lens-shaped, semi-elliptical or elongated-rectangular shape.

13. The cladding panel according to claim 9, wherein the cement of an applied bead or strip (8) is deformable, under the action of water, moisture or constant pressure and is matched to the cross-sectional shape of the recess (10), simultaneous with development of adhesive action and fills up a free space of the recess (10) if cement compound in excess is present.

14. The cladding panel according to claim 13, wherein the bead (8) and the other bead (9) rise over the wall surface (5) of the groove (12) or over the tongue surface (7) and projects from these surfaces (5, 7), the beads (8) and (9) having a rounded cross-sectional contour surfaces or flanks projecting outside the recess (10).

15. The cladding panel according to claim 9, wherein the bead (8) and the other bead (9) adhere securely in the recess (10) and surfaces (5) of the groove (12) and the tongue surfaces (7).

16. The cladding panel according to claim 1, wherein the cement of the bead (8) or of the other bead (9) is water-soluble upon contact with water or moisture so the bead or strip can be partially dissolved in water-soluble glue from which the bead is formed.

17. The cladding panel according to claim 1, wherein the legs (3, 4) of the groove (12) are the same length with the leg (4) of the groove (12) on the back of the panel (1, 2) being slightly shorter width than the leg (3) on the front of the panel (1, 2) and at least one leg (3, 4) of the groove (12) being elastically bent when the tongue (6) is inserted in the groove (12).

18. The cladding panel according to claim 1, wherein each panel (1, 2) is provide on front surface has at least a decorative plastic coating on the front surface thereof.

19. The cladding panel according to claim 1, wherein the groove (12) and the tongue (6) are in and made from the material of the panel (1, 2) by milling the panel, the tongue (6) being formed integrally with the material of the panel (1, 2).

20. The cladding panel according to claim 1, wherein a gap (16) is formed between the end faces (17) of the panels (1, 2).

21. The cladding panel according to claim 1, wherein the bead or strip (8) that has been applied in a recess (10) or the other bead or strip (9) projects over the respective tongue surface (7) and the respective wall surface (5) of the groove (12) with a projecting part of the bead or strip (8) or (9) acting as a catch or locking element.

22. The cladding panel according to claim 1, wherein when the panels are locked, the cross-section of the bead (8) and the cross-section of the other bead (9) intersect so that surface areas of the beads (8) or (9) are in contact so as to adhere when under pressure.

23. The cladding panel according to claim 1, wherein the bead or strip (8) or the other bead or strip (9) are applied roughly in the middle to the tongue surface (7) or to the wall (5) of the groove (12) or the leg (3, 5) at a distance from the end face (17) of one of the panels (1, 2).

24. The cladding panel according to claim 1, wherein the beads (8) and (9) have a width (B) and a height (H) wherein the width (B) is twice to nine times as great as the height (H).

25. The cladding panel according to claim 24, wherein the width (B) is two to seven times as great as its height (H).

26. The cladding panel according to claim 1, wherein the bead or strip (8) or the other bead or strip (9) has a width (B) and the groove (12) has a thickness (D) wherein the width (B) is 5 to 25% of the thickness (D).

27. The cladding panel according to claim 26, wherein the bead or strip (8) or the other bead or strip (9) have a height (H) and wherein the width (B) is three to seven times as great as its height (H).

28. The cladding panel according to claim 1, wherein in the interlocked position of the groove (12) and tongue (6), the bead (8) and the other bead (9) lie next to one another, in a position of touching one another or applying pressure to one another.

29. The cladding panel according to claim 1, wherein the bead (8) and the other bead (9) are comprised of an adhesive-latent cement material wherein the cement material is convertable into an adhesive state by wetting with water.

30. The cladding panel according to claim 29, wherein the cement material of the cement bead (8) and the other bead (9), is applied with a uniform layer having thickness of 0.1 to 0.6 mm, especially 0.2 to 0.5 mm, at thickness tolerances in the range from ±0.05 to 0.1 mm.

31. The cladding panel according to claim 29, wherein the cement material of the cement bead (8) of the other bead (9) is formed by a quick-setting or mounting glue based on polyvinyl acetate or by a commercial wood glue based on starch and protein.

32. The cladding panel according to claim 1, wherein the area of the tongue (6) located in front of the bead (8) the other bead or strip (9) toward the free end of the tongue (6) is in the form of a rounding or bevelling surface (24) that directly adjoins the bead (8) or the other bead (9).

33. The cladding panel according to claim 1, wherein the tongue (6') is an elongated, strip-shaped component having two opposing narrow sides in two areas on at least one tongue surface (7'), the tongue (6') has at least one bead (8) that runs lengthwise and that runs parallel to a lengthwise extension of the component, whereby in at least one leg (3, 4) of the grooves (12) formed in each case in the panels (1, 2), at least one other positionally-assigned cement bead (9) is applied.

34. The cladding panel according to claim 33, wherein the strip-shaped component is symmetrical at least with respect to one of its lengthwise center planes, and is made symmetrical with respect to a center plane that lies perpendicular to its surface or to the plane of the panel.

35. The cladding panel according to claim 33, wherein the component or the external tongue is inserted at the factory into a groove (12) in a lengthwise side and optionally into a groove (12) of a narrow side of a panel (1, 2).

36. The cladding panel according to claim 1, wherein the opposing legs of the groove (12) have a leg that is closer to the surface of the panel (12) and a leg that is 'further from the surface of the panel (12) wherein the leg (3) that is closer is stronger so as to be less elastically bendable than the leg (4) that is further and wherein the beads (8) or (9) are made only on the tongue surface (7) that is pointed down and on the wall surface (5) of the lower leg (4) of the groove (12).

37. The cladding panel according to claim 1, wherein the groove (12) and the tongue (6) are made to run perpendicular to the surface of the panel (1, 2), and by a movement that takes place perpendicular to the plane of the panel, at least one bead (8) that has been attached to at least one tongue surface (7) or at least one wall surface (5) of the groove (12) can be locked or cemented to at least one other bead (9) that is attached to at least one wall surface (5) of the groove (12) or at least one tongue surface (7).

38. The cladding panel according to claim 37, wherein the outside leg (4) of the groove (12) of one panel (1, 2), which groove runs perpendicular to the panel surface, can be inserted into a groove (12') that is made between the tongue (8) of a panel (2, 1) to be connected and its panel body (31) by a movement that takes place perpendicular to the panel surface, and at least one bead (8) that is attached to at-least one tongue surface (7) or at least one wall surface (5) of the groove (12) can be locked and cemented to at least one other bead (9), which is attached to at least one wall surface (5) of the groove (12) or at least one tongue surface (7), or recess (9).

39. The cladding panel according to claim 37, wherein on a panel (1, 2) at least along one lengthwise side and along one narrow side, a groove (12) that is open to the top is provided, and along one lengthwise side and optionally along one narrow side, a tongue (6) that proceeds down is milled out.

40. The cladding panel according to claim 1, wherein the bead (8) extends behind the bead (9) when the panels 1 and 2 are assembled.

41. The cladding panel according to claim 1, wherein the beads (8, 9) in the locked position are exposed to the action of pressure or force by at least one groove leg (3, 4) that has been widened or bent when the tongue (6) is inserted into the groove (12).

42. The Cladding panel for floors, walls or ceilings, according to claim 1, which cladding panels have a groove (12) along at least one edge (17) and a tongue (6) along at least one other edge (17), the panels (1, 2) to be connected to one another being connectable by insertion of the tongue (6) into the groove (12) in the course of displacement that takes place in the plane of the panel or perpendicular to the plane of the panel in the course of swivelling, and at least one catch projection being formed on the tongues (6) or grooves (7), wherein on at least one wall surface (5) of the groove (12) on its legs (3, 4) and on at least one tongue surface (7), at least one bead (8) of cement or plastic that has been applied at the factory and that extends especially parallel to or along edge (17) in the lengthwise direction of the cladding panel is applied or bonded as a projection, and on the tongue (6) on the tongue surface (7) facing the wall surface (5) of the groove (12), which tongue surface is provided with the bead (8), in the groove (12) or in its legs (3, 4) on the wall surface (5) facing the tongue surface (7) that is provided with the bead (8), at least one other bead (9) is formed as a projection for locking with the bead or strip (8) in the joined state of two adjacent panels (1, 2).

43. The cladding panel according to claim 1, wherein at least one bead (8) and at least one other bead (9) extend parallel to or along the edge (17) or in the lengthwise direction of the panel (1, 2).

44. The cladding panel according to claim 1, wherein the groove (12) and curved groove side surfaces or inner surfaces and the tongue (6) have curved tongue surfaces.

45. The cladding panel according to claim 44, wherein the tongue surfaces and the groove surfaces are each curved in the same direction and have radii of curvature that point to the same side of the cladding panel.

46. The cladding panel according to claim 45, wherein the two curved tongue surfaces and the two curved groove side surfaces each run parallel to one another.

47. The cladding panel according to claim 1, wherein the groove (7) has a thickness that decreases in the direction of the groove base and the tongue (6) has a thickness that decreases in the direction of the tongue free end.

48. The cladding panel according to claim 1, wherein the beads (8) that are located on the tongue (6) or the beads (9) in the groove (12) lie opposite one another.

49. The cladding panel according to claim 1, wherein the tongue (6) and the groove (12) have cross sections that are matched to one another.

50. The cladding panel according to claim 1, wherein the thickness of the tongue and the height of the groove are selected such that insertion of the tongue is possible when the bead (8) and the other bead (9) lock or move past one another at the same time.

51. A cladding panel of claim 1 where there is a single first bead (8) and a single second bead (9), the single beads or strips (8, 9) being located on surfaces (7) and (5) of the tongue (6) and groove (12) which face one another with the second bead (9) being positioned closer to the second edge (17) than the first bead (8) is to the first edge (17), whereby the cladding panel locks with adjacent similar cladding panels.

52. Panel according to claim 1, wherein the beads (8) and (9) are formed of a pressure cement that adheres when pressure is applied thereto.

53. The cladding panel according to claim 52, wherein the bead (8) or the other bead (9) has a hardness, toughness and viscosity sufficient that the beads withstand insertion of the tongue (6) into the groove (12) as the free end of the tongue (6) slides into the groove (12) without permanent deformation of the beads, and wherein after insertion of the tongue (6) the beads act as locking elements against emergence of the tongue (6) from the groove (12) until adhesion between the beads (8 and 9) occurs.

54. The cladding panel according to claim 1, wherein both beads (8 and 9) are formed of an adhesive cement, adhesive plastic or adhesive composite of cement and plastic.

55. The cladding panel according to claim 1, wherein the beads (8 and 9) are deformed while inserting or withdrawing the tongue from the groove.

* * * * *